United States Patent [19]

Charvin et al.

[11] Patent Number: 4,706,596

[45] Date of Patent: Nov. 17, 1987

[54] ACTUATOR USABLE IN A FLUID UNDER HIGH PRESSURE

[75] Inventors: Philippe Charvin, Massy; Paul Vavasseur, Boullay les Trouxllimars, both of France

[73] Assignee: Commissariat a l'Energie Atomique, Paris, France

[21] Appl. No.: 811,005

[22] Filed: Dec. 19, 1985

[30] Foreign Application Priority Data

Jan. 3, 1985 [FR] France ..... 85 00038

[51] Int. Cl.[4] ..... B63G 8/00

[52] U.S. Cl. ..... 114/312; 74/2; 405/193

[58] Field of Search ..... 114/312, 317, 330, 331; 74/2, 89.15; 405/193, 185

[56] References Cited

U.S. PATENT DOCUMENTS 2,361,949 11/1944 Langdon ..... 114/317
2,778,226 1/1957 Lardin ..... 74/2
3,006,196 10/1961 Brackett ..... 74/2
3,782,316 1/1974 Schalosbe et al. ..... 405/185 X
4,187,796 2/1980 Ess ..... 405/193 X
4,416,313 11/1983 Seeger ..... 74/89.15

FOREIGN PATENT DOCUMENTS 2518204 12/1982 France .
1306469 2/1973 United Kingdom .

*Primary Examiner*—Sherman D. Basinger
*Attorney, Agent, or Firm*—Cesari and McKenna

[57] ABSTRACT

An actuator usable in a first fluid under a high pressure, e.g. on board a submarine operating at great depths to release or jettison ballast and wherein the first fluid is external to the submarine, comprises a plunger which is mobile by means of a spring and is held in place by a locking member. The plunger, its spring and the locking member are located within a frame which is filled with a second fluid, while a flexible skirt and two deformable sleeves enable the pressure of the second fluid to adapt constantly to that of the first fluid.

19 Claims, 6 Drawing Figures

ACTUATOR USABLE IN A FLUID UNDER HIGH PRESSURE

BACKGROUND OF THE INVENTION

The present invention relates to an actuator of the plunger type usable in a highly pressurized fluid, e.g. on board a submarine craft able to work at great depths.

Numerous submarine vessels and equipments require the use of mechanically acting actuators either for transmitting a force (releasing ballast, grasping objects, etc.) or for carrying out locking or unlocking. Most of these systems are based on increasing the forces with the aid of levers moved by mechanical systems or hydraulic systems. In the latter case, the craft has to carry a hydraulic generator, These means have to be used at widely varying immersion levels, e.g. at depths between 0 and 11,000 metres when used underwater, or in a liquid which can contain solid suspensions. The main problem is to maintain the optimum reliability level (particularly in the case of ballast release), so that the design of such actuators is far from easy.

SUMMARY OF THE INVENTION

The object of the present invention is to obviate these disadvantages by proposing an actuator able to operate independently of the pressure, the corrosive action and the turbidity of the ambient medium by utilizing the linear displacement of a piston, said displacement taking place with a high degree of reliability and only requiring a small amount of energy.

In conventional manner, the actuator according to the invention comprises a plunger which is mobile with respect to a structure and connected thereto by elastic means, e.g. a spring, as well as means for locking the plunger relative to said structure. According to the invention, at least part of the plunger, the elastic means and the locking means are housed within a frame containing a second fluid and the actuator has means enabling the pressure of the fluid contained in the frame to constantly adapt to that of the external fluid. For simplification purposes, throughout the remainder of the present text, the expression "first fluid" is used for designating the fluid in which the complete actuator operates, while the term "second fluid" is understood to mean the fluid located within the frame.

According to the preferred embodiment of the invention, the means enabling the pressure of the second fluid to constantly adapt to that of the first incorporate a flexible skirt having a first end tightly fixed to the mobile plunger and a second end tightly fixed to the frame, said flexible skirt separating the first and second fluids, and at least one deformable sleeve tightly fixed to the frame and whose interior communicates with the internal space of said frame, said sleeve separating the first and second fluids and being able to deform under the action of the pressure variations of the first fluid.

According to another feature of the invention, within the frame is provided at least one partition perforated by a pipe permitting the passage of the second fluid. The latter is displaced within the frame when the actuator is put into operation and the diameter of the pipe or pipes is calculated as a function of the force to be exerted by the plunger during the operation of the actuator.

According to another feature of the actuator according to the invention, the plunger locking means comprise a locking member mobile between a plunger locking position and a plunger unlocking position, an electromagnet and a ram mobile within the frame and connected thereto by elastic means, said ram being contactable with the electromagnet and cooperating with the locking member in such a way as to maintain the latter in the locking position when the ram is in contact with the electromagnet.

The locking member can either be a rocking lever rotatable about a fixed spindle with respect to the frame or a free rocking lever, or it can be formed by a plurality of balls mobile within a recess provided in the frame.

According to a first embodiment, the electromagnet only produces a magnetic field and consequently only attracts the ram when an electric current flows through it. According to a second embodiment, the electromagnet has a permanent magnetization coil, said magnetization being cancelled out by the passage of a current in the coil. Thus, in this variant, the ram is only attracted by the electromagnet when the supply circuit is open. Finally, it is possible to provide within the frame a screw-nut system controlled by a motor making it possible to bring the plunger back to its locking position.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
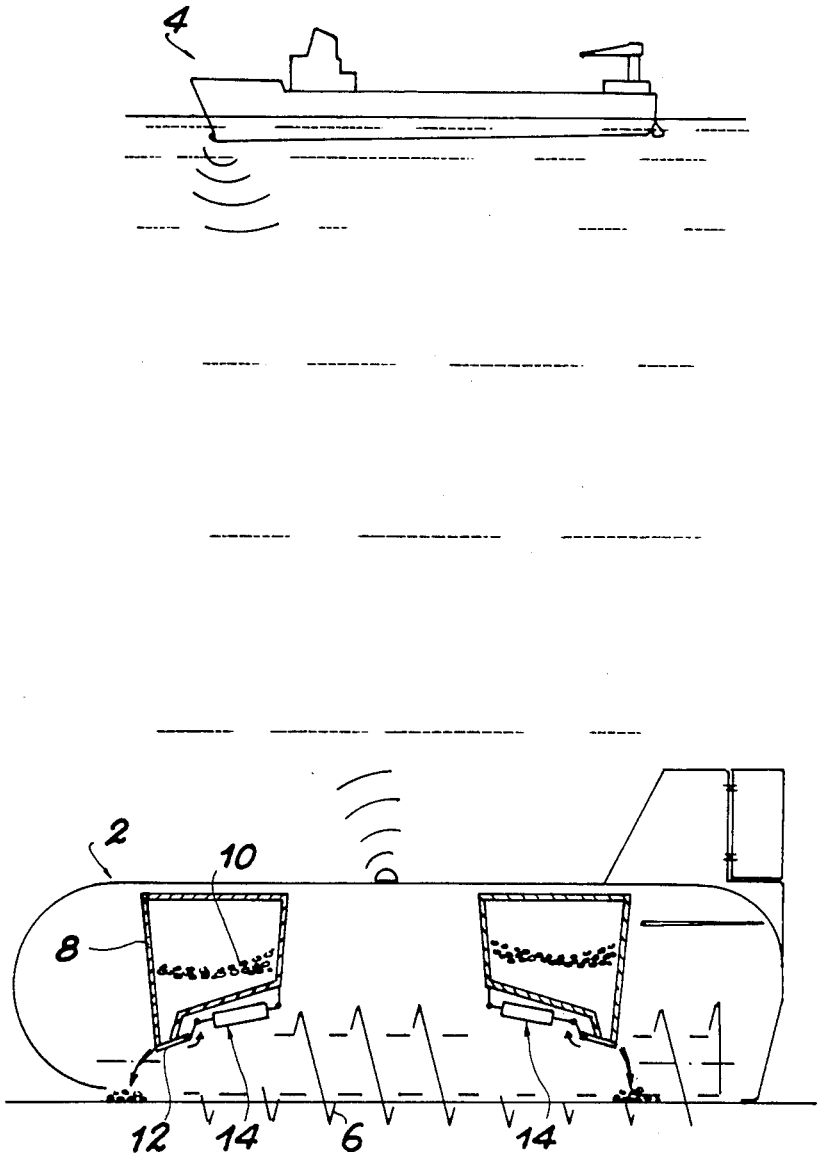
FIG. 1 is a diagramatic view showing a submarine working on the ocean bed and equipped with an actuator according to the invention.

FIG. 1 shows a submarine vessel 2, e.g. a vessel for collecting nodules, which travels along the ocean bed either autonomously, or guided remotely from a ship 4. Submarine 2 moves with the aid of Archimedean screw 6 and can have one or more tanks such as 8 containing ballast 10. In the case of certain operational incidents, it may be necessary to release or jettison ballast 10, in order that submarine 2 can rise to the surface again. This can take place, e.g. by opening a door or flap 12 with the aid of an actuator 14 like that according to the invention.

Figure 2:
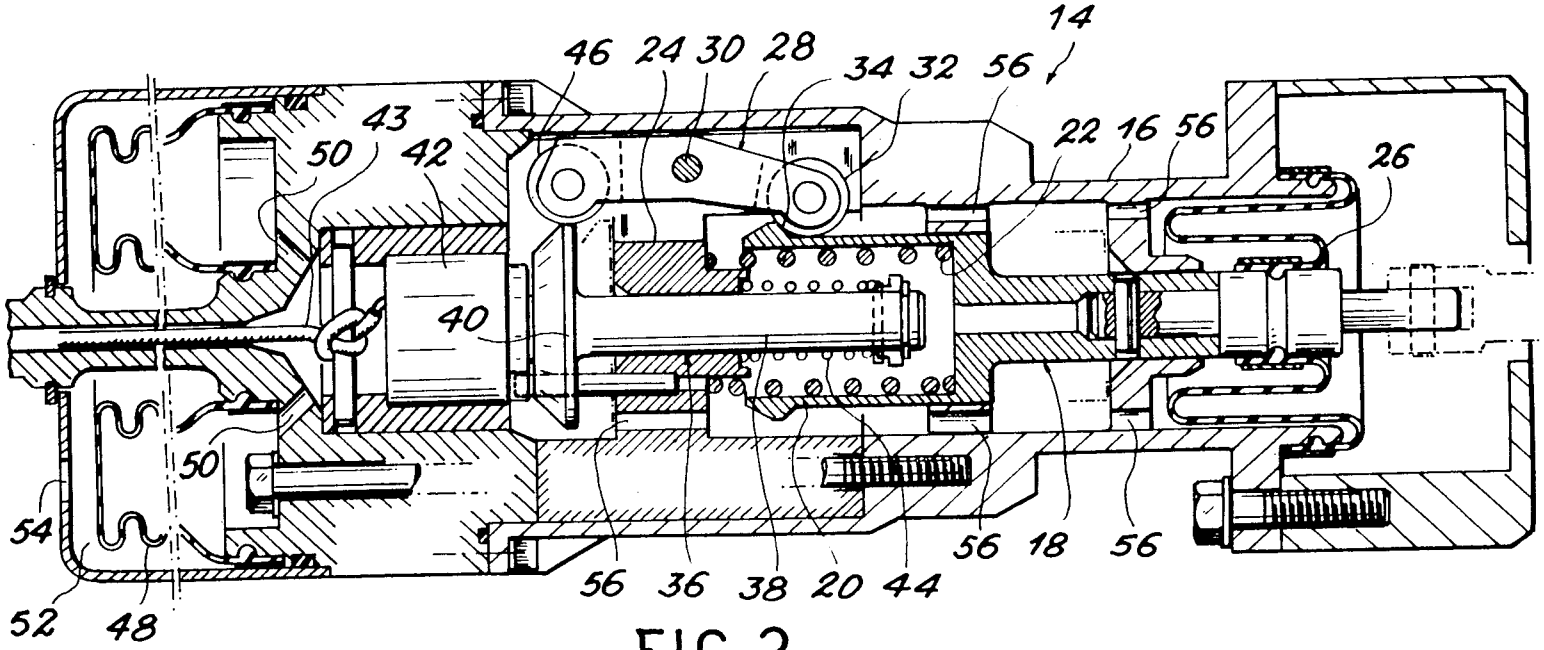
FIG. 2 is a diagramatic sectional view of the actuator according to the invention when the plunger is in the locked position.

The actuator can best be seen from the detailed sectional view of FIG. 2. It can be seen that the actuator comprises a tight frame 16 within which can move a plunger 18. Frame 16 is filled with a fluid called the "second fluid" as compared with the "first fluid" which is that in which the vessel is submerged. The rear part 20 of plunger 18 is hollow and contains a spring 22, whereof one end is fixed to plunger 18, while its other end is fixed to a member 24 integral with frame 16. A flexible skirt 26, whose function will be explained hereinafter, is tightly fixed on the one hand to the front part of plunger 18 and on the other to frame 16. FIG. 2 illustrates the locking position, in which the plunger 18 is held with the aid of a rocking lever 28, which can pivot about a spindle 30 fixed with respect to frame 16. At one of its end, the rocking lever 28 carries a rounded part 32 which, in the locking position illustrated in FIG. 2, is in contact with an edge 34 provided on the rear part 20 of plunger 18 and consequently prevents any movement of the latter. In this position, spring 22 is in the compressed state.

The rocking lever 28 is prevented from rotating by a ram 36, which is also mobile within frame 16. Ram 36 is constituted by a body 38 and a head 40, which can come into contact with an electromagnet 42. The latter is connected to a not-shown supply device by a group of wires in a cable 43. One of the ends of a spring 44 is fixed to body 38 of ram 36 and its other end is fixed to member 24 integral with frame 16. FIG. 2 shows that the head 40 of ram 36 has dimensions such that when it is in contact with electromagnet 42, it abuts against a rounded part 46 on the end of the rocking lever 28 opposite to the rounded part 32, which prevents any pivoting of the rocking lever in counterclockwise direction in FIG. 2 and maintains the plunger 18 in the locking position.

FIG. 2 also shows two deformable sleeves 48 tightly fixed to frame 16 in such a way that their internal space communicates with the internal space of said frame via pipes such as 50, while the second fluid in frame 16 is also located within said sleeves 48.

Figure 3:
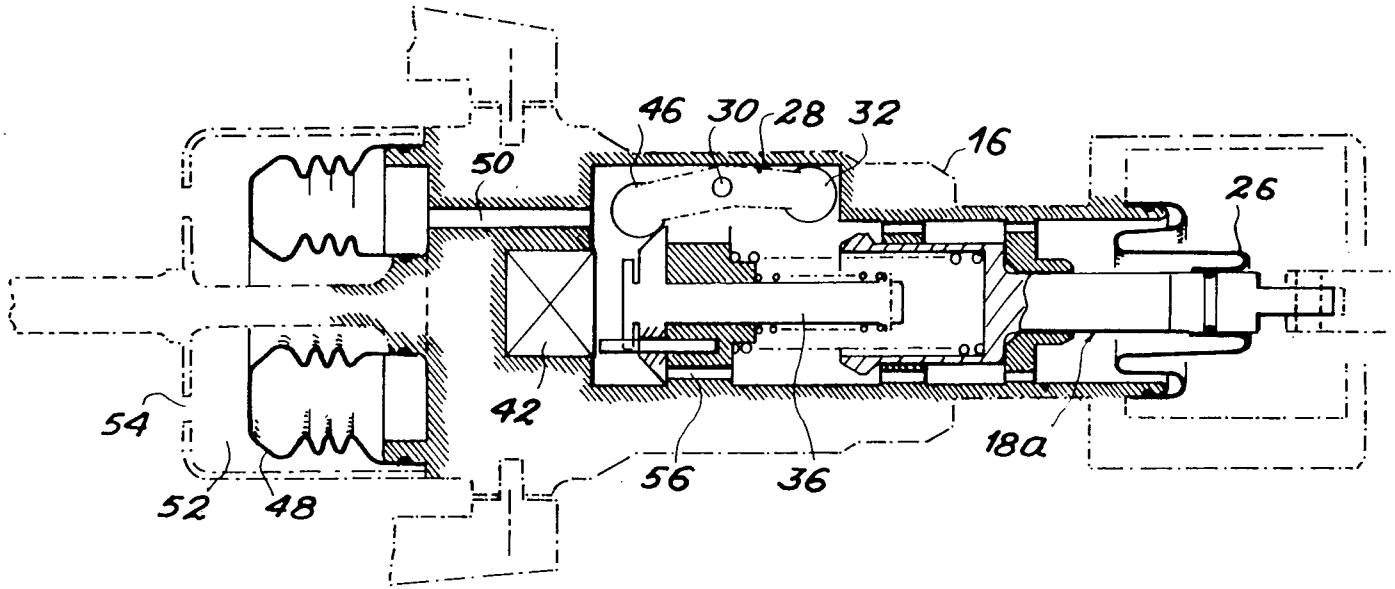
FIG. 3 is a simplified diagramatic view similar to FIG. 2 and illustrating the position of the assembly following the operation of the actuator.

A description will now be given of the operation of the actuator with reference to FIGS. 2 and 3. In a first embodiment, electromagnet 42 is permanently excited and consequently attracts the head 40 of ram 36, so that rocking lever 28 and plunger 18 are maintained in the locked position. When it is wished to jettison the ballast, the power supply to electromagnet 42 is interrupted, so that is stops attracting ram 36. Under the action of spring 44, the latter is moved to the right in FIG. 2 and arrives in the position illustrated in FIG. 3. The rounded part 46 of rocking lever 28 is no longer held in place, so that it can pivot about spindle 30. This pivoting has the effect of raising the rounded part 32, which is no longer in contact with the abutment face 34 of plunger 18. Thus, the latter can be moved under the action of spring 22 and controls a mechanism, which is not shown in FIGS. 2 and 3. The final position shown in FIG. 3 is then reached and, in this position, plunger 18 and ram 36 have moved to the right of the drawing, while the rocking lever 28 has pivoted counterclockwise from its position in FIG. 2.

This also has the effect of displacing flexible skirt 26 and to provide a larger space for the fluid contained in frame 16 in this part of the actuator. At the same time, the flexible sleeves 48 are crushed under the action of the pressure of the sea water. Thus, FIGS. 2 and 3 show that the sleeves 48 are located within a compartment 52 communicating with the ambient medium by openings such as 54. Thus, the pressure of the sea water has the effect of crushing sleeves 48, so that the volume available for the fluid contained in frame 16 constantly adapts to the pressure variations due to the ambient medium.

It is also possible to see a certain number of pipes 56 acting as a dash pot, whose diameter has been defined in such a way as to control the velocity of the second fluid when the actuator is put into operation, i.e. when skirt 26 is opened out and sleeves 48 are crushed. In this way it is possible to control the force with which the plunger 18 acts on the elements which it has to displace. Apart from the use of the actuator on board a submarine, where arming takes place outside the first fluid by compressing the piston by an appropriate means, arming can be carried out by means of a device incorporated within the actuator.

Figure 4:
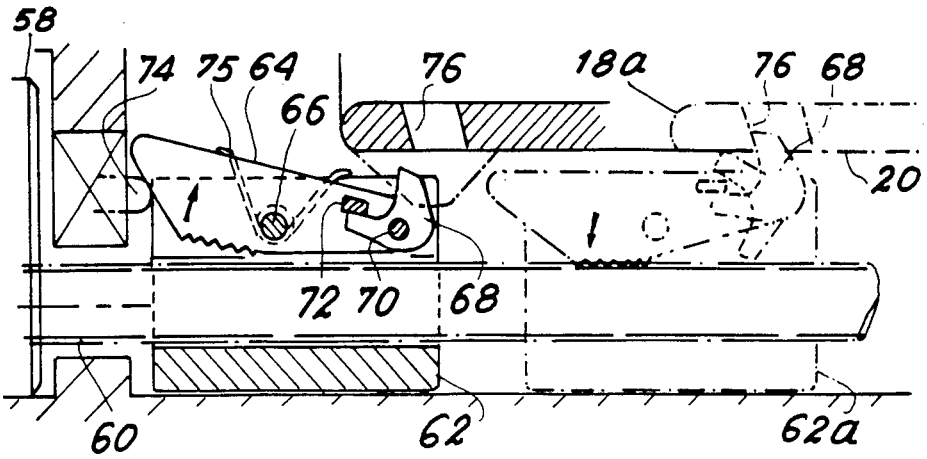
FIG. 4 is a diagramatic sectional view illustrating the screw-nut system making it possible to bring the plunger into the locked position.

FIG. 4 illustrates one of these devices. A screw-nut system is used for bringing the plunger 18 into a locking position once the system has operated. This device comprises a micromotor 58, which is fixed with respect to frame 16 and controls a threaded rod 60, which is mobile in rotation and fixed in translation. A nut 62, which is fixed in rotation but free in translation, can move along rod 60. Nut 62 carries a rocking lever 64, which is rotatable about a spindle 66 carried by said nut 26, the rocking lever 64 being drawn towards rod 60 by a spring 75. Rocking lever 64 also carries a catch 68, which is rotatable about a spindle 70 carried by the rocking lever, said catch 68 being contactable with a catch abutment or stop 72. It should be noted that the catch 68 is free, its travel being limited by stop 72. In its starting position, the rocking lever 64 is in the vicinity of micromotor 58 and is in a raised position as a result of a stop 74 controlled by the motor. When the plunger 18 has operated, it is located in position **18*a* (FIGS. 3 and 4) i.e. on the right-hand side of FIG. 4. When it is wished to bring it into the locking position, motor 58 is started up, which has the effect of overriding stop 74 and of bringing the rocking lever 64 into the horizontal position, whilst rotating rod 60. Nut 62 consequently moves to the right in the drawing to position 62*a* diagramatically illustrated by mixed lines. During this movement, when catch 68 meets the outer face of the rear part 20 of plunger 18, it rocks in counterclockwise direction in FIG. 4 and then returns to its normal position when facing an opening 76 provided in part 20 of plunger 18. Catch 68 is then in contact with one of the faces of said opening and motor 58 is started up so as to bring plunger 18 from position 18*a* into its locking position. At this time, nut 62 has returned to its starting position and the control of stop 74 has the effect of pivoting the rocking lever 64 in the clockwise direction in FIG. 4. Catch 68 is then extracted from opening 76 and no longer prejudices the movement of plunger 18** during the next starting up thereof.

Figure 5:
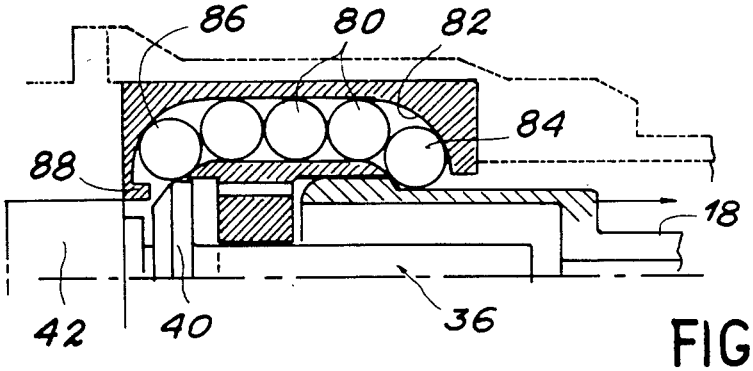
FIG. 5 is a part diagramatic view illustrating the case where the locking member is constituted by a plurality of balls.

FIG. 5 illustrates a variant in which the rocking lever 28 of FIG. 2 is replaced by a group of balls 80 mobile within a recess 82. The end balls 84, 86 fulfil the same function as the rounded parts 32 and 46 of rocking lever 28. The balls 80 can either be embedded in a flexible material such as rubber, or can be free to move within recess 82. To prevent the end balls 84, 86 from moving out, the travel of plunger 18 is sufficiently short for its rear part to prevent ball 84 from dropping, whilst ball 86 is retained by an abutment 88.

Figure 6:
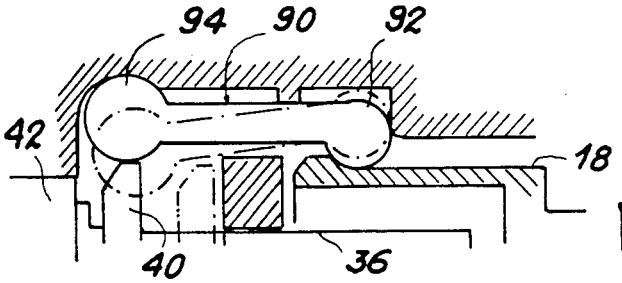
FIG. 6 is a diagramatic view similar to FIG. 5 illustrating the case where the locking member is constituted by a free rocking lever.

Finally, in the embodiment of FIG. 6, the pivoting rocking lever 28 of FIG. 2 is replaced by a free rocking lever 90, which has at its two ends rounded parts 92, 94, which fulfil the same function as the rounded parts 32, 46 of rocking lever 28 in FIG. 2. Rocking lever 90 is a free rocking lever, i.e. it is not mounted on a fixed spindle or shaft as is rocking lever 28 and can instead move freely within its recess when the actuator is started up. However, as in FIG. 5, the travel of plunger 18 and of ram 36 and the shape of the recess of rocking lever 90 are determined in such a way that the latter cannot escape.

Thus, the actuator according to the invention has interesting advantages because it is simple to construct and operates reliably. Moreover, it involves a limited mechanical action determined by the calibration of springs 22 and 44 and by the diameter of pipes, such as 56. Furthermore, as the complete mechanism is located within a fluid-filled tight frame, there are no problems due to corosion and the turbidity of the ambient medium. Finally, the presence of skirt 26 and sleeves 48 ensures that the internal space of frame 16 is permanently entirely filled with a fluid, whose pressure is automatically adjusted to that of the surrounding medium. It is consequently possible to operate at any depth, i.e. close to the surface with a low pressure, or on the ocean bed (approximately 11,000 meters for the deepest ocean troughs), where the pressure is very high.

Finally, it is obvious that the invention is not limited to the embodiments described hereinbefore and can, in fact, cover all variants thereof without passing beyond the scope of the invention. For example, the operation of the actuator has been described in the case where the electromagnet is permanently excited, the interruption of the power supply leading to the disengagement of ram 36 from electromagnet 42. However, it would not pass outside the scope of the invention to use a reverse system, in which the electromagnet has a coil attracting the head 40 of ram 36 as a result of its permanent magnetization, the latter being cancelled out when the coil is made live. Finally, it would also not pass outside the scope of the invention to use systems other than that described in FIG. 4 for bringing the plunger into the locking position or by using systems other than the balls or rocking levers for maintaining the plunger in the locked position.

What is claimed is:

1. An actuator usable in a fluid under a high pressure, called the first fluid, of the type having a plunger which is mobile with respect to a structure and connected thereby by a spring, as well as means for locking the plunger with respect to said structure wherein at least part of the plunger, the spring and the locking means are located within a closed frame containing a second fluid and wherein the actuator has enabling means enabling the pressure of the second fluid in the frame to constantly adapt to that of the first fluid.

2. An actuator according to claim 1, wherein the means enabling the pressure of the second fluid to constantly adapt to that of the first fluid incorporate a flexible skirt having a first end tightly fixed to the mobile plunger and a second end tightly fixed to the frame, said flexible skirt separating the first and second fluids, and at least one deformable sleeve tightly fixed to the frame and whose interior communicates with the space within the frame, said sleeve separating the first and second fluids and being able to deform under the effect of variations in the pressure of the first fluid.

3. An actuator according to claim 1, wherein the space within the frame has at least one partition traversed by a pipe permitting the passage of the second fluid, the diameter of said pipe determining the force exerted by the plunger during the operation of the actuator.

4. An actuator according to claim 1, wherein the plunger locking means comprise a locking member mobile between a plunger locking position and a plunger unlocking position, an electromagnet and a ram mobile within the frame and connected thereto by elastic means, whereby said ram can come into contact with the electromagnet and cooperates with the locking member so as to maintain the latter in the locked position when the ram is in contact with the electromagnet.

5. An actuator according to claim 4, wherein the locking member is a rocking lever mobile in rotation about a spindle fixed with respect to the frame.

6. An actuator according to claim 4, wherein the locking member is a free rocking lever.

7. An actuator according to claim 4, wherein the locking member is constituted by a plurality of balls mobile within a recess provided in the frame.

8. An actuator according to claim 4, wherein the electromagnet only produces a magnetic field when an electric current passes through it.

9. An actuator according to claim 4, wherein the electromagnet has a permanent magnetization coil, the magnetization being cancelled out by a current passing through the coil.

10. An actuator according to claim 1, wherein said actuator also has a nut-screw system controlled by a motor for returning the plunger to the locked position.

11. An actuator usable in a fluid under a high pressure, called the first fluid, of the type having a plunger which is mobile with respect to a structure and connected thereto by elastic means, as well as means for locking the plunger with respect to said structure wherein at least part of the plunger, the elastic means and the locking means are located within a closed frame containing a second fluid and wherein the actuator has means enabling the pressure of the second fluid in the frame to constantly adapt to that of the first fluid, said enabling means incorporating a flexible skirt having a first end tightly fixed to the mobile plunger and a second end tightly fixed to the frame, said flexible skirt separating the first and second fluids, and at least one deformable sleeve tightly fixed to the frame and whose interior communicates with the space within the frame, said sleeve separating the first and second fluids and being able to deform under the effect of variations in the pressure of the first fluid.

12. An actuator according to claim 11, wherein the space within the frame has at least one partition traversed by a pipe permitting the passage of the second fluid, the diameter of said pipe determining the force exerted by the plunger during the operation of the actuator.

13. An actuator according to claim 11, wherein the plunger locking means comprise a locking member mobile between a plunger locking position and a plunger unlocking position, an electromagnet and a ram mobile within the frame and connected thereto by elastic means, whereby said ram can come into contact with the electromagnet and cooperates with the locking member so as to maintain the latter in the locked position when the ram is in contact with the electromagnet.

14. An actuator according to claim 13, wherein the locking member is a rocking lever mobile in rotation about a spindle fixed with respect to the frame.

15. An actuator according to claim 13, wherein the locking member is a free rocking lever.

16. An actuator according to claim 13, wherein the locking member is constituted by a plurality of balls mobile within a recess provided in the frame.

17. An actuator according to claim 13, wherein the electromagnet only produces a magnetic field when an electric current passes through it.

18. An actuator according to claim 13, wherein the electromagnet has a permanent magnetization coil, the magnetization being cancelled out by a current passing through the coil.

19. An actuator according to claim 11, wherein said actuator also has a nut-screw system controlled by a motor for returning the plunger to the locked position.

* * * * *